US007690584B2

(12) United States Patent
Geissele et al.

(10) Patent No.: US 7,690,584 B2
(45) Date of Patent: Apr. 6, 2010

(54) FASTENER FOR SUPPORTING RAILROAD TIES

(75) Inventors: William Hugo Geissele, Waterford Works, NJ (US); Frank Howard Coats, Thorofare, NJ (US)

(73) Assignee: Pandrol Limited, Addlestone, Surrey (GB)

( * ) Notice: Subject to any disclaimer, the term of this patent is extended or adjusted under 35 U.S.C. 154(b) by 582 days.

(21) Appl. No.: 11/343,430

(22) Filed: Jan. 30, 2006

(65) Prior Publication Data

US 2006/0151626 A1 Jul. 13, 2006

Related U.S. Application Data

(63) Continuation-in-part of application No. 10/652,011, filed on Aug. 29, 2003, now Pat. No. 7,080,791.

(60) Provisional application No. 60/430,560, filed on Dec. 3, 2002.

(51) Int. Cl.
*E01B 9/38* (2006.01)

(52) U.S. Cl. ..... 238/264

(58) Field of Classification Search ..... 238/2, 238/264, 283, 349, 351, 294, 295, 306
See application file for complete search history.

(56) References Cited

U.S. PATENT DOCUMENTS

| | | | | |
|---|---|---|---|---|
| 2,076,019 | A | | 4/1937 | Fifield |
| 3,311,331 | A | | 3/1967 | Steimen |
| 4,047,663 | A | | 9/1977 | Reynolds et al. |
| 4,155,507 | A | | 5/1979 | Chierici et al. |
| 4,316,578 | A | | 2/1982 | Reynolds et al. |
| 4,572,431 | A | * | 2/1986 | Arato ..... 238/283 |
| 4,648,554 | A | | 3/1987 | McQueen |
| 5,022,584 | A | | 6/1991 | Sherrick |
| 5,110,046 | A | | 5/1992 | Young |
| 5,261,599 | A | | 11/1993 | Brown |
| 5,335,850 | A | | 8/1994 | Igwemezie |
| 5,405,081 | A | | 4/1995 | Bosshart |
| 5,520,330 | A | | 5/1996 | Brown et al. |
| 5,549,245 | A | | 8/1996 | Kish |
| 5,551,633 | A | | 9/1996 | Kish et al. |
| 5,566,882 | A | | 10/1996 | Brown et al. |
| 5,735,458 | A | | 4/1998 | Brown et al. |
| 6,045,052 | A | * | 4/2000 | Besenschek ..... 238/382 |
| 6,386,461 | B1 | | 5/2002 | Wildgoose |

* cited by examiner

*Primary Examiner*—S. Joseph Morano
*Assistant Examiner*—Robert J McCarry, Jr.
(74) *Attorney, Agent, or Firm*—Gottlieb, Rackman & Reisman, P.C.

(57) ABSTRACT

A fastener for supporting a rail on a railroad tie using clips, includes an abrasion plate having an upper surface, and being constructed and arranged to fit on the railroad tie; a rail pad having a lower surface and being constructed and arranged to fit on said abrasion plate with said lower surface facing and contacting said upper surface and to support the rail; a pair of insulators disposed on said rail pad, said insulators being configured to receive the clips when the fastener is installed and to insulate said fastener from said clips; and coupling means integrally formed on one of said abrasion plate and said rail pad to hold said pair of insulators prior to the installation of the fastener.

19 Claims, 4 Drawing Sheets

10
16
18
3
3
4
4

90
92
10
12
38
36
46
16A
16B
16
16C
22
22
52
42
14
16
48
50
34
44
30
54
56
62
60
66
32
72
76
18
18A
18A
64
70
58
68
18
78
18A
20
33

FASTENER FOR SUPPORTING RAILROAD TIES

RELATED APPLICATIONS

This application is continuation-in-part to application Ser. No. 10/652,011 filed Aug. 29, 2003, claiming priority to provisional application Ser. No. 60/430,560 filed Dec. 3, 2002, now U.S. Pat. No. 7,080,791 and incorporated herein by reference.

BACKGROUND OF THE INVENTION

1. Field of Invention

This invention pertains to a novel rail fastener, and more particularly, to a fastener formed of an abrasion plate resting on the railroad tie, a pad disposed on the plate and supporting the rail and a pair of insulators disposed on the side of the pad. Means are provided to bundle the abrasion plate, the pad and the insulators so that they can be stored, shipped and installed easily as a single unit.

2. Description of the Prior Art

During the last decades, the old wooden ties used to support railroad rails were replaced by concrete ties and pads were provided between the rails and the concrete ties. These pads provided two functions: they acted as shock absorbers for the rails and they provided electrical insulation. This latter function is important for railroad systems in which the rails form a part of the electrical circuitry for either the motive power, signaling or control functions. Separate rail clips or other similar fasteners are used to clamp the rail to the ties. For example, commonly owned U.S. Pat. No. 5,110,046, incorporated herein by reference, discloses a two part rail fastener: an elastomeric pad and an abrasion plate resting on the tie. The abrasion plate was made of a heat treated high carbon steel. The abrasion plate was provided on its bottom surface with a layer of adhesive to secure it to the concrete tie. Other rail fasteners have been developed with an abrasion plate made of a plastic material.

The rails are retained in the assembly by a spring clip made of a steel bar. Another means of supporting a rail consists of a metal clip such as the SAFELOK® available from Pandrol® USA of Bridgeport, N.J. The clips are mounted to the pad with a pair of insulators, one insulator being disposed on each side of the rail.

However, problems still remain with rail fasteners. One problem is that, after excessive use, the concrete tie under the fastener gets worn and has to be repaired. A further problem is that over time rails tend to expand and contract longitudinally due to temperature changes, and as a result of train movement. This action tends to separate the two parts of the fastener.

A further problem with the prior art support assembly has been that its several components had to be kept together to eliminate assembling them in the field. The traditional way to implement this was to tie the components together with plastic or fiberglass tape. Tape is unsatisfactory because it is time-intensive to apply the tape. Moreover, if the tape is weak, the components could easily separate.

SUMMARY OF THE INVENTION

Briefly, in order to eliminate the use of fiberglass tape and instead thereof to afford an easier and more economical attachment for the subject fastener, it is contemplated to utilize a stake or post. The basic design of this feature is a protruding plastic post which is provided on one of the components of the fastener and is dimensioned to fit through corresponding holes in the other components. In the preferred form of the present invention, since the rail pad rests on the abrasion plate the post is provided on and as a part of the abrasion plate and a corresponding hole is formed in the rail pad (but the arrangement could just as well be the reverse), such that in the assembled state an end portion of the post extends from the hole. The stake is formed with a radially collapsing head so that when it is desired to attach the two components to each other, as the head of the post passes through the hold, it partially collapses or flexes slightly inward. Once it passes through the hold, the head expands so that its lateral dimension is greater than the diameter of the hole. In this manner, the hole in effect captures the stake head thereby holding the pad and the plate together.

Moreover, as mentioned above, the fastener further includes two insulators. In the prior art assemblies, the insulators did not overlap. In the present invention, the insulators are shaped to overlap the plate and the pad. Moreover, the insulators are also formed with holes positioned to register with the holes of the pad. As a result, the posts and the holes provide a means of keeping together the plate, the pad and insulators.

Each abrasion plate and rail pad may, of course, be provided with more than one post and one hole, as the case may be.

The rail pad and the abrasion plate should not be assembled tightly together because the rail pad must be free to locate itself around the insulators. Therefore, the "heat stake" and the holes of the present invention is so implemented that there will be a large annular clearance between the post and the holes.

Another addressed by the present invention relates to insufficient longitudinal restraint of the rail. A contributing factor to low longitudinal restraint was thought to be the lack of a positive mechanical lock between the abrasion plate and the rail pad. It will be understood that as the rail moves longitudinally under operational or environmental conditions, it tries to drag the rail pad along. The corresponding movement of the rail pad had previously been restrained by a combination of arrangements, such as protruding ears that fit around the shoulders, rectangular upstands that engage the side post insulator, and surface finish modifiers designed into the rail fastener.

The interlocking mechanism of the present invention consists of a pattern of male protrusions on the top face of the abrasion plate and a corresponding pattern of female recesses or depressions on the bottom face of the rail pad. The interlocking features are designed with clearance at initial assembly and positioning. This allows the rail pad and the abrasion plate to take up their corresponding positions in the rail seat region with respect to the differing positions of the shoulders and the side post insulators.

The present interlocking feature also affords an additional method of restraining the abrasion plate. As the pad moves longitudinally relative to the abrasion plate, the clearance between the male protrusions and the female depressions is decreased until contact occurs. The multiple points of contact positively lock the abrasion plate and the rail pad together, thereby increasing longitudinal restraint.

DETAILED DESCRIPTION OF THE INVENTION

Figure 1:
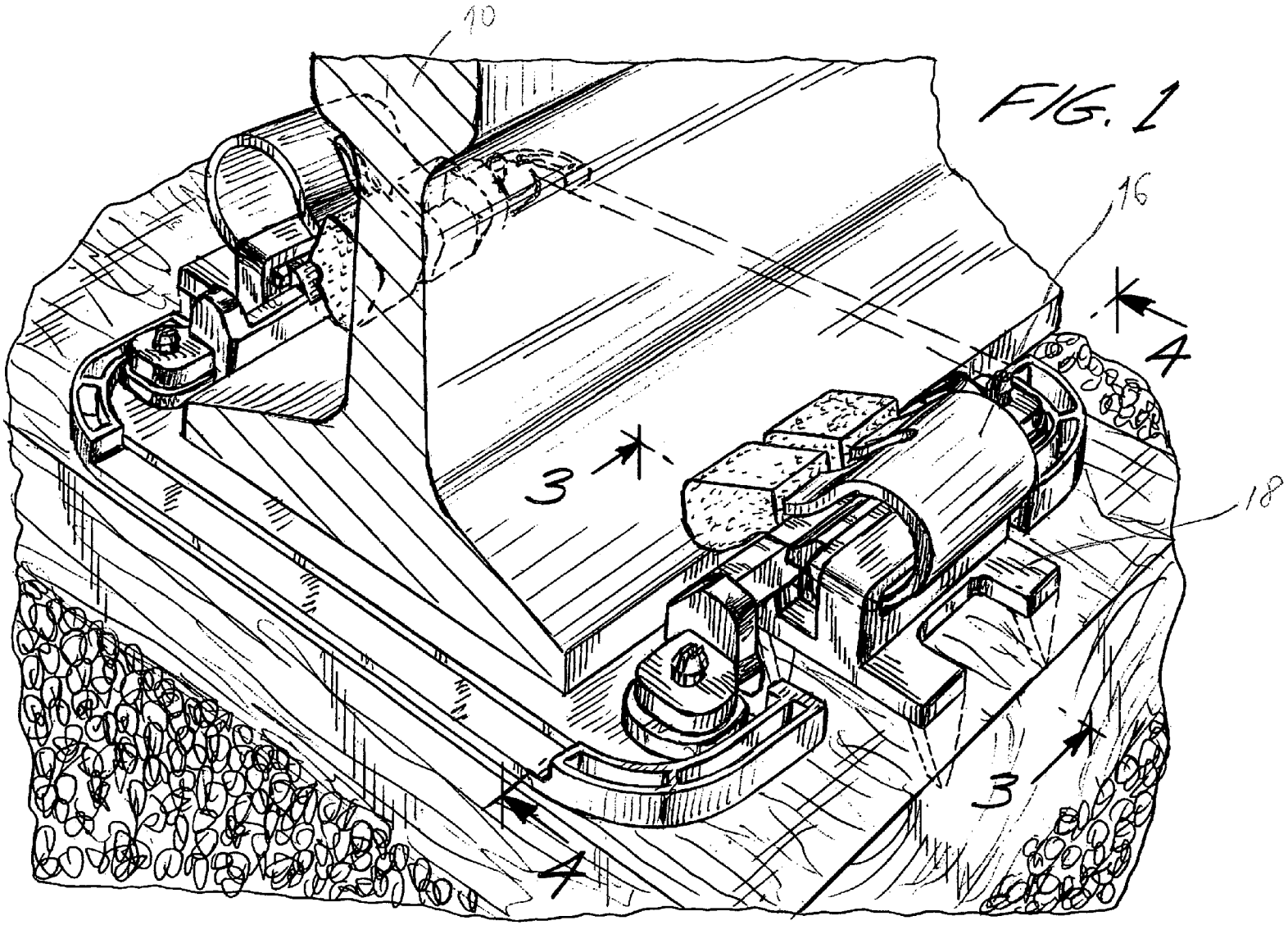
FIG. 1 shows an isometric view of a rail supported by a fastener and a concrete tie in accordance with this invention.
Figure 2:
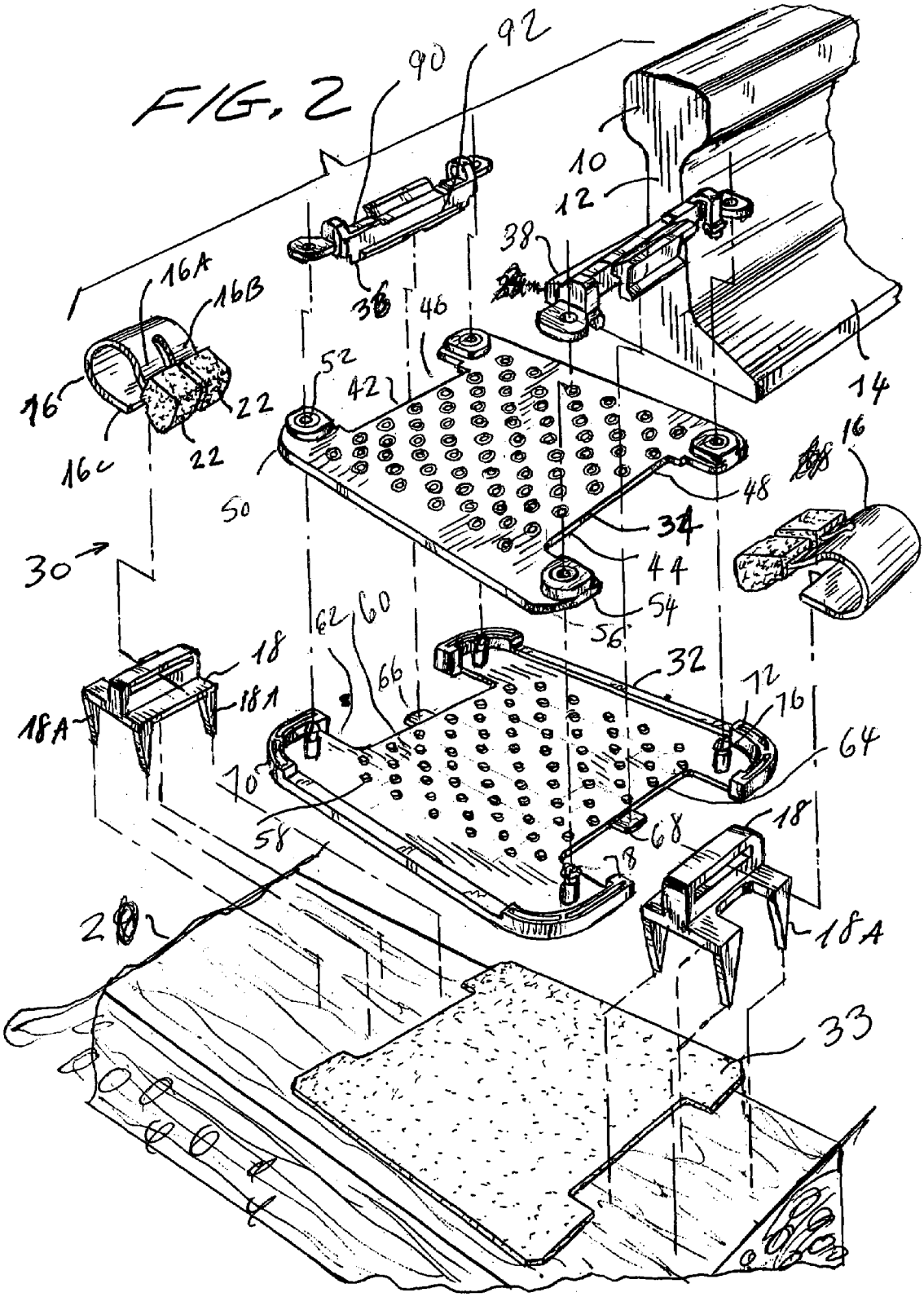
FIG. 2 shows an isometric exploded view of the components of the up the rail fastener of FIG. 1.

The Figures shows a standard rail 10 with a web 12 and a flange 14 and is supported on a concrete tie 20 by a fastener 30. A curved clip 16 made of steel has is attached to an anchor (not shown) that is imbedded in the tie 20. The clip 16 engages an anchor 18 made of steel, iron or other metallic compound. The clip 16 has two arms 16A, 16B and a base 16C. The arms 16A, 16B are terminated with a respective wedge 22 that push down on the flange 14 as shown. The steel anchor 18 has several legs 18A that penetrate the cement tie 20. In this manner, the fastener 30 is sandwiched between the rail flange 14 an the tie 20. The fastener 30 includes an abrasion plate 32, a bottom pad 33, which could be a foam gasket or other material, a top pad 34 and two insulators 36, 38.

The pad 34 is made of a high impact plastic material and has a generally H-shaped outline with a main body 40 and two transversal sides 42 and 44 (the terms transversal and longitudinal are used herein with reference the longitudinal axis of rail 10).

The sides of pad 34 are formed with two respective rectangular cutouts 46 and 48 designed to wrap around the insulators 36, 38, respectively, as seen in FIG. 1. The sides 42, 44 are formed with two arms 50, each having a raised cylindrical boss 52. The through holes 54 extend through the pad 34. The arms 50 have curved sides 56.

Figure 3:
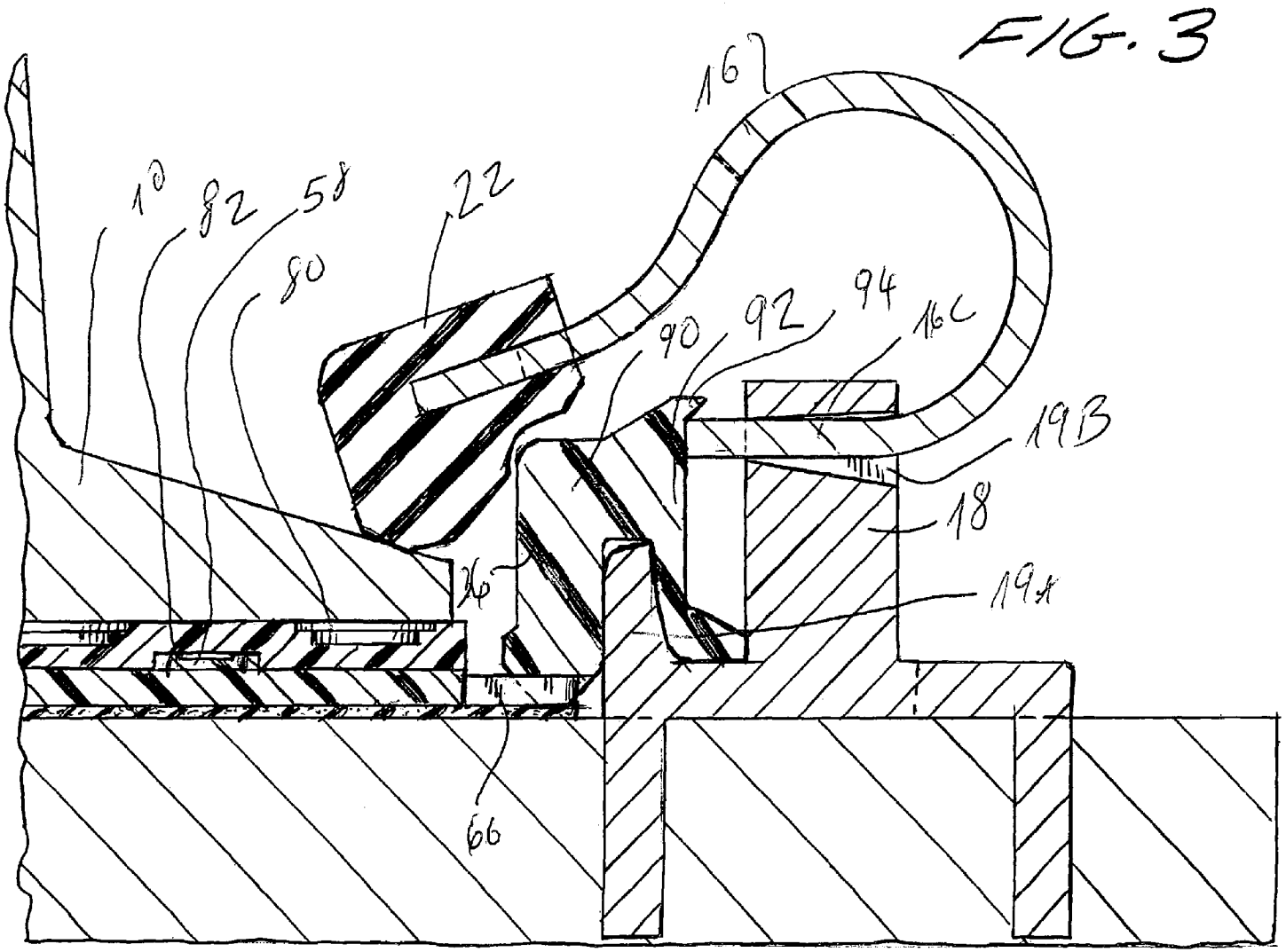
FIG. 3 shows a partial transversal side elevational view of the fastener of FIGS. 1-2 as the fastener is mounted on a railroad tie and hold a rail.

In addition, the pad 34 also has a first set of circular dimples 80 on its top surface and a second set of circular dimples 82 on its bottom surface. The two sets of dimples 80, 82 have the same size dimples but the dimples 82 are laterally offset so that they do not match the positions of top dimples 80. Both sets of dimples are distributed evenly across the pad 34 and under the rail 10, as can be seen in FIG. 3. It has been shown that patterns with this distribution are effective in converting the vertical forces on the rails 10 and fastener can be effectively diffused and spread across the surface of pad 34.

The abrasion plate 32 is made of a high impact plastic material and also has a generally H-shaped outline with a flat portion 60 and two transversal sides with cutouts 62 and 64 similar to cutouts 42, 44 on the pad 34. The plate 32 further includes arms 70 disposed along the cutouts 62, 64. Tabs 66 are provided in the middle of each cutout 62, 64. Each arm 70 is formed with a raised wall 72 having an arcuate shape. These walls 72 are sized and shaped so that they are complementary to the curved sides 56.

Figure 4:
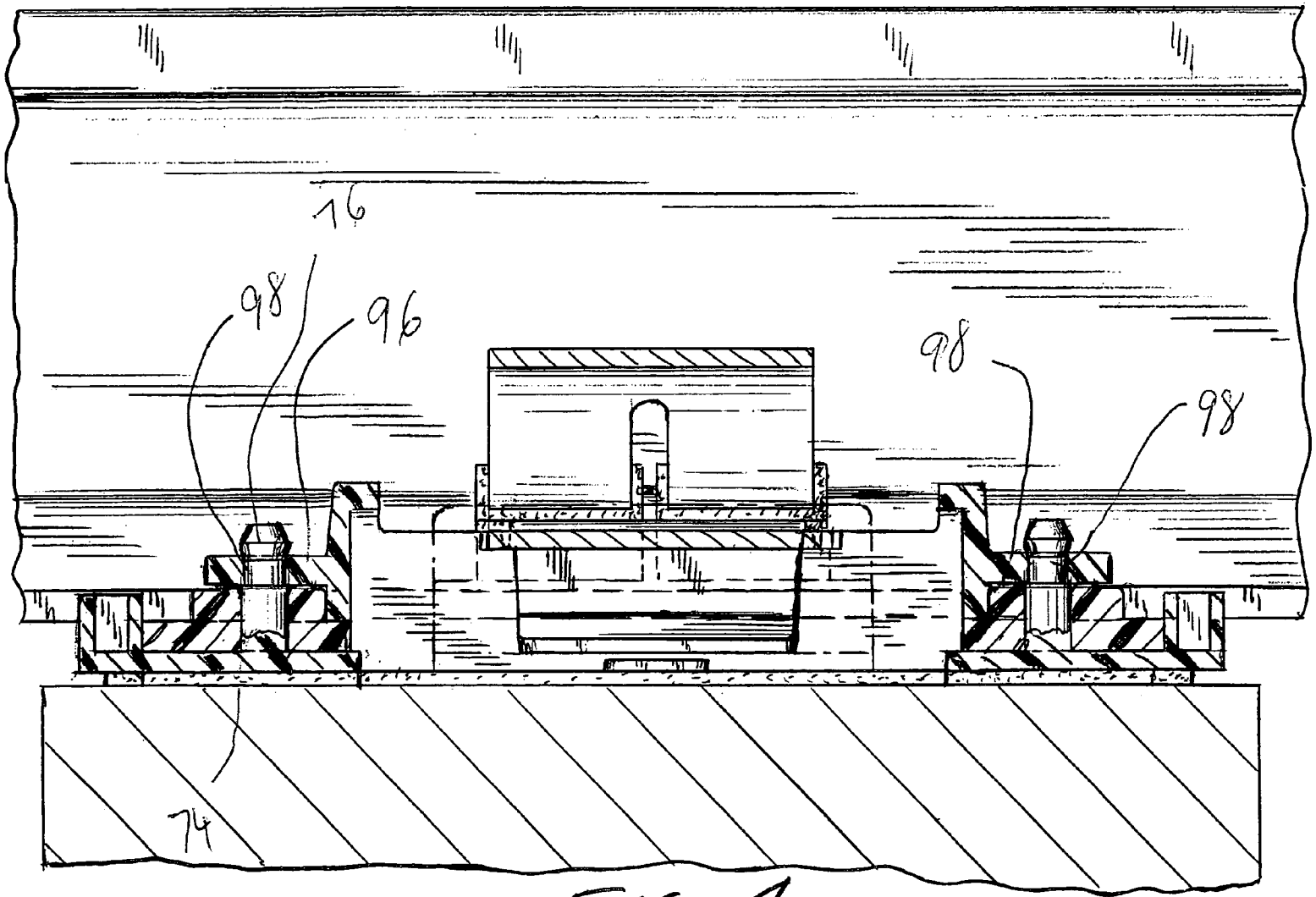
FIG. 4 shows a partial transversal side elevational view of the fastener of FIGS. 1-2 as the fastener is mounted on a railroad tie and hold a rail.

Each arm 70 also holds a coupling stalk 74 rising vertically upwards, above, the flat portion 60. As shown in FIGS. 1 and 4, each stalk terminates with a mushroom shaped head 76 with a split 78. The split is formed to render the head 76 flexible so that it can be bent or collapsed radially inwardly thereby reducing the effective diameter of the head 76 so that it can fit through hole 54 in the pad 34.

The flat section 60 is formed with a pattern of protrusions 58 on its top surface 60. The protrusions 58 are evenly distributed at least on the portion of the plate 32 that is below rail 10. As seen in FIG. 3, the protrusions 58 are constructed and arranged so that when the pad 34 are positioned on top of plate 32, each protrusion 58 fits and extends into a matching dimple 82. Preferably, the diameter of dimples 82 are larger then protrusions 58. The diameter of a portion of the stalks 74 disposed below their heads 76 are also smaller then the diameters of holes 56. Thus, the elements of the the plate 32 and pad 34 are dimensioned to allow the pad 34 and plate 32 to shift laterally with respect to each other.

The insulators 36 and 38 are also made of a high impact plastic material. Each has an elongated body 90 with a side wing 92, as shown in FIG. 3. At one top edge, the body 90 is formed with an edge 94. Each insulator is seated on one of the tabs 66 and the steel anchor 18. The anchor has a lip 19 and each insulator 36, 38 is shaped so that that its body 90 and the wing 92 straddle the lip 19. The spring 16 is positioned so that its base 16C extends through a hole 19B and abuts the wing 92. The spring 16 is maintained in this position by edge 94. The remaining portion of the clip extends oer the steel anchor 18 and the insulator 36 so that the coil end with the insulator 22 is rests and presses down on the rail 10.

The components and features of the insulator 36, 38 are similar to prior art insulators. However, in the present invention, each insulator is provided at its longitudinal ends with respective round extensions 96. Each extension is formed with a hole 98, as shown in FIG. 4. Again, hole 98 has a diameter then the diameter of the portion of spike 74 disposed under its head 76.

After the elements of the fastener 10 are completed, they are assembled together by placing the pad 32 over the plate 34 and pushing it down to force the four spikes 74 through holes 54. The insulators 36, 38 are mounted in the same way, thereby forming a fastener assembly that can be shipped easily to the site. Once at the site, the fastener is used to mount rail 10 on the ties 20 as discussed.

Optionally bottom pad 33 may also be provided. Preferably pad 33 is a closed cell foam made, for example form high density polyehtylene. The pad 33 can be shipped separately, or can be attached to the fastener assembly in any known manner, including a wrapping with a fiberglass tape (not shown).

While the invention has been described with reference to several particular embodiments, it is to be understood that these embodiments are merely illustrative of the principles of the invention. Accordingly, the embodiments described in particular should be considered as exemplary, not limiting, with respect to the following claims.

We claim:

1. A fastener for supporting a rail on a railroad tie using clips, said fastener comprising:

an abrasion plate having an upper surface, and being constructed and arranged to fit on the railroad tie;

a rail pad having a lower surface and being constructed and arranged to fit on said abrasion plate with said lower surface facing and contacting said upper surface and to support the rail;

a pair of insulators disposed on said rail pad, said insulators being configured to receive the clips when the fastener is installed and to insulate said fastener from said clips, said insulators being formed with insulator holes having a n insulator hole dimension; and a coupling element integrally formed on said rail pad to hold said pair of insulators prior to the installation of the fastener, said coupling member including a spike having an enlarged head with a head dimension larger then said insulator hole dimension, said spike being arranged and constructed to collapse as said head is inserted through one of said insulator hole and then expand after said enlarged head passes through causing said spike to be captured within said respective insulator hole.

2. The fastener of claim 1 wherein said coupling means include a plurality of spikes terminating in an enlarged head, and wherein said insulators include holes positioned to receive said spikes.

3. The fastener of claim 2 wherein said rail pad includes a plurality of pad holes, said spikes extending to said insulators through said pad holes to capture said rail pad.

4. The fastener of claim 1 further comprising a bottom plate disposed under said abrasion plate.

5. The fastener of claim 1 wherein said spikes have split heads that bend transversally.

6. The fastener of claim 1 wherein said coupling element is arranged to capture said pair of insulators before the fastener is mounted and secured to the tie.

7. A railroad fastener for securing a railroad track to a railroad tie, said fastener comprising:

an abrasion plate having a generally flat body and adapted for placement on the tie;

a rail pad arranged to be placed on top of said abrasion pad and to support the rail;

a coupling adapted to couple said abrasion plate and said rail pad, said coupling including a spike dependent on said abrasion plate and a pad hole adapted to receive said spike and formed on said rail pad, said spike having a tip extending through said pad hole when said rail pad is disposed on said abrasion pad; and two insulators captured by said coupling, said insulators being configured to receive the clips and insulate said rail pad from the clips, said insulators being formed with insulator holes having an insulator hole dimension;

wherein said spike is formed with an enlarged head having a head dimension larger then said insulator hole dimension, said spike being arranged and constructed to extend through said pad hole and said insulator hole, with said head being deformed when passing through said insulator hole and then extending to allow said spike head to be captured within said insulator hole.

8. The railroad fastener of claim 7 wherein said coupling includes a plurality of spikes dependent on said abrasion plate, each spike head extending through and being capture by respective insulator holes.

9. The railroad fastener of claim 7 wherein said head is formed with a vertical cut to allow said spikes to collapse partially when inserted through said holes.

10. The railroad fastener of claim 7 wherein said rail pad has a plurality of corners and said abrasion plate has a flat portion and a plurality of side walls formed on said flat portion and arranged to receive said corners.

11. The railroad fastener of claim 10 wherein said spikes are formed on said corners adjacent to said side walls.

12. The fastener of claim 7 wherein said coupling element holds said abrasion plate, said rail pad and said insulators together prior to the installation of said fastener to the railroad tie.

13. A railroad fastener assembly for securing a railroad track on a railroad tie, said railroad fastener assembly comprising:

an abrasion plate having an upper surface, and being constructed and arranged to fit on the railroad tie;

a rail pad having a lower surface and being constructed and arranged to fit on said abrasion plate with said lower surface facing and contacting said upper surface and to support the rail;

a plurality of clips arranged to secure the rail on top of said rail pad;

a plurality of anchors attaching said clips from said tie;

a pair of insulators disposed between said clips and said rail pad; and a plurality of spikes integrally formed on said abrasion plate and arranged to capture said insulators, each said spike having an enlarged head that is smaller than a corresponding hole in said insulators for receiving said spike, said spikes being arranged and constructed to deform laterally at their respective heads as said heads pass through the holes to allow the holes to capture the spikes by their heads.

14. The assembly of claim 13 wherein said rail pad has holes and said spikes pass through the holes of the railroad pads and the holes of said insulators.

15. The fastener assembly of claim 13 wherein said plate, pad and said insulator are held together as a subassembly that is stored and transported prior to installation on the rails.

16. The fastener of claim 13 wherein said abrasion plate and said rail pad are formed with at least one cutout each and wherein at least one insulator is formed with a body fitting into said cutout, said body being interposed between said clip and said rail pad and said abrasion plate.

17. The fastener of claim 16 wherein said abrasion plate and said rail pad include at least one hole, each, disposed adjacent to said cutout and said one insulator includes at least one extension attached to said body and extending over rail pad plate with an insulator hole in alignment with said hole in the rail pad to receive said spike.

18. A fastener for supporting a rail on a railroad tie using clips, said fastener comprising:

an abrasion plate having an upper surface, and being constructed and arranged to fit on the railroad tie;

a rail pad having a lower surface and being constructed and arranged to fit on said abrasion plate with said lower surface facing and contacting said upper surface and to support the rail;

a pair of insulators disposed on said rail pad, said insulators being configured to receive the clips when the fastener is installed and to insulate said fastener from said clips, said insulators being formed with insulator holes having a n insulator hole dimension; and a coupling element integrally formed on said rail pad to hold said pair of insulators prior to the installation of the fastener, said coupling member including a spike having an enlarged head with an enlarged head with a head dimension larger then said insulator hole dimension, said spike being formed with a vertical cut constructed and arranged to allow said head to collapse as said head is inserted through one of said insulator hole and then expand after said enlarged head passes through causing said spike to be captured within said respective insulator hole.

19. A railroad fastener assembly for securing a railroad track on a railroad tie, said railroad fastener assembly comprising:

an abrasion plate having an upper surface, and being constructed and arranged to fit on the railroad tie;

a rail pad having a lower surface and being constructed and arranged to fit on said abrasion plate with said lower surface facing and contacting said upper surface and an upper surface to support the rail;

a plurality of clips arranged to secure the rail on top of said rail pad;

a plurality of anchors attaching said clips from said tie;

a pair of insulators disposed between said clips and said rail pad; and a plurality of spikes integrally formed on said abrasion plate and arranged to capture said insulators, each said spike having an enlarged head that is larger than a corresponding hole in said insulators for receiving said spike, said spikes formed with a vertical cut in said head, said cut being arranged and constructed to allow said head to flex laterally as said heads pass through the holes to allow the holes to capture the spikes by their heads.

* * * * *